US007717751B2

(12) United States Patent
Bellotto et al.

(10) Patent No.: US 7,717,751 B2
(45) Date of Patent: May 18, 2010

(54) ELECTRICAL CONNECTOR FOR A PRINTED CIRCUIT CARD AND HERMETICALLY TIGHT ELECTRICAL CASE CONTAINING ONE SUCH CONNECTOR

(75) Inventors: Henri Bellotto, Saint Martin d'Heres (FR); Patrizio Nuccio, Gieres (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 243 days.

(21) Appl. No.: 11/902,266

(22) Filed: Sep. 20, 2007

(65) Prior Publication Data

US 2009/0209135 A1 Aug. 20, 2009

(30) Foreign Application Priority Data

Oct. 12, 2006 (FR) ..... 06 08921

(51) Int. Cl.
*H01R 24/00* (2006.01)

(52) U.S. Cl. ..... 439/629

(58) Field of Classification Search ..... 439/629, 439/59, 79, 80, 377, 625, 607.01
See application file for complete search history.

(56) References Cited

U.S. PATENT DOCUMENTS

| | | | | |
|---|---|---|---|---|
| 3,941,448 | A * | 3/1976 | Evans | 439/493 |
| 5,277,611 | A * | 1/1994 | Berek et al. | 439/325 |
| 5,575,663 | A | 11/1996 | Broschard, III et al. | 439/79 |
| 5,944,536 | A * | 8/1999 | Seong et al. | 439/79 |
| 6,315,620 | B1 * | 11/2001 | Moir et al. | 439/862 |
| 2002/0002012 | A1 | 1/2002 | Torrii | 439/625 |
| 2002/0004337 | A1 | 1/2002 | Chiang | 439/607 |

FOREIGN PATENT DOCUMENTS

| | | |
|---|---|---|
| EP | 0 817 327 | 1/1998 |
| GB | 1458706 | 12/1976 |

* cited by examiner

*Primary Examiner*—Chandrika Prasad
(74) *Attorney, Agent, or Firm*—Steptoe & Johnson LLP

(57) ABSTRACT

An electrical connector designed to be connected to the edge of a printed circuit card having a first face placed in contact with a support. Said connector comprises at least one metal blade designed to be in contact with an electrical track placed on a second face of the printed circuit card, and at least one securing means designed to secure the electrical connector on the edge of said card. Said at least one metal blade is designed to exert a gripping force on the printed circuit card to keep the latter in contact with the support, movement of the electrical connector and of the printed circuit card being limited in at least one direction perpendicular to the faces of the printed circuit card.

18 Claims, 5 Drawing Sheets

ELECTRICAL CONNECTOR FOR A PRINTED CIRCUIT CARD AND HERMETICALLY TIGHT ELECTRICAL CASE CONTAINING ONE SUCH CONNECTOR

BACKGROUND OF THE INVENTION

The invention relates to an electrical connector designed to be connected to the edge of a printed circuit card, a first face of which card is placed in contact with a support. Said connector comprises at least one metal blade designed to be in contact with an electrical track placed on a second face of the printed circuit card, and at least one securing means designed to secure the electrical connector to the edge of the printed circuit card.

The invention also relates to a case containing a printed circuit card whereto such an electrical connector is connected.

STATE OF THE PRIOR ART

The use of electrical connectors connecting on the edge of a printed circuit card is widespread in particular in the computer hardware field. These connectors generally comprise one or more metal blades which come into contact with one or more electrical tracks placed on one or two of the faces of the printed circuit card. The shape of the metal blade is configured in such a way as to apply a sufficient contact force for a good electrical conduction between the connector and the electrical circuit.

Generally, additional means enable the card to be secured on a support placed in a case. The support comprises for example mechanical grips collaborating with the printed circuit card to hold the latter in position.

The electrical connector or connectors are generally connected to the printed circuit card after the latter has been fitted on the support.

Mechanical and electrical connection of the card and connector therefore require several distinct means. Moreover, several assembly steps are necessary which increases the time required for electrical and mechanical installation of the printed circuit card in the case.

SUMMARY OF THE INVENTION

The object of the invention is therefore to remedy the shortcomings of the state of the art so as to propose an electrical connector comprising securing means on the card which are simple and quick to use.

The electrical connector according to the invention comprises at least one metal blade designed to exert a gripping force on the printed circuit card to keep the latter in contact with the support, movement of the electrical connector and of the printed circuit card being limited in at least one direction perpendicular to the faces of the printed circuit card.

According to one embodiment of the invention, at least one securing means comprises at least one first securing surface designed to operate in conjunction with positioning means of the support.

Advantageously, the distance separating the metal blade and the first securing surface is larger than the thickness of the edge of the printed circuit card.

According to one embodiment of the invention, the printed circuit card is designed to be gripped indirectly between the metal blade and said at least first securing surface, a part of the support being placed between the metal blade and said at least first securing surface.

Advantageously, said at least one securing means comprise at least one second securing surface, the distance separating the metal blade and the second securing surface being substantially equal to the thickness of the edge of the printed circuit card.

Advantageously, the printed circuit card is designed to be gripped directly between the metal blade and said at least second securing surface.

Preferably, the electrical connector comprises at least one latching zone designed to operate in conjunction with at least one latching means of the support, movement of the electrical connector being limited in at least one direction parallel to the faces of the printed circuit card.

In a particular embodiment, the electrical connector comprises at least two insulating centering fingers placed in parallel manner on each side of said at least one metal blade, each centering finger having a front surface designed to be facing the second face of the printed circuit card.

Preferably, the centering fingers have a larger length than that of said at least one metal blade.

Preferably, the centering fingers comprise an inclined plane at the level of their front surface perpendicular to the faces of the printed circuit card.

In a particular embodiment, the connector comprises several metal blades, each metal blade being designed to be connected to an electrical track of the printed circuit card.

Preferably, the metal blades are separated by insulating separating fingers placed parallel to said blades.

Preferably, the separating fingers are of smaller length than that of the metal blades.

Preferably, each metal blade is flexible.

Advantageously, the connector comprises at least one electrical test zone giving access to a non-insulated electrical surface connected to a metal blade An electrical case according to a development of the invention comprises a printed circuit card connected to at least one electrical connector as described above. Said card is positioned on a support delineating at least one first internal confinement volume inside the support. The case comprises a cover designed to cover the printed circuit card positioned on said support, and delineating at least one second internal confinement volume between the cover and the second face of the printed circuit card. The cover comprises an internal positioning periphery collaborating with an external periphery formed by the edge of the printed circuit card and by said at least one electrical connector connected to said edge so as to reduce the fluxes of polluting particles entering the first and second confinement volumes.

Advantageously, the cover comprises an internal insulating wall dividing the first internal confinement volume into two internal confinement sub-volumes and preventing the fluxes of polluting particles from passing from a first confinement sub-volume to the other.

Preferably, the metal blades, the insulating separating fingers and the insulating centering fingers of the electrical connector or connectors are placed inside one and the same confinement sub-volume.

BRIEF DESCRIPTION OF THE DRAWINGS

Other advantages and features will become more clearly apparent from the following description of particular embodiments of the invention, given as non-restrictive examples only and represented in the accompanying drawings, in which.

DETAILED DESCRIPTION OF AN EMBODIMENT

Figure 1:
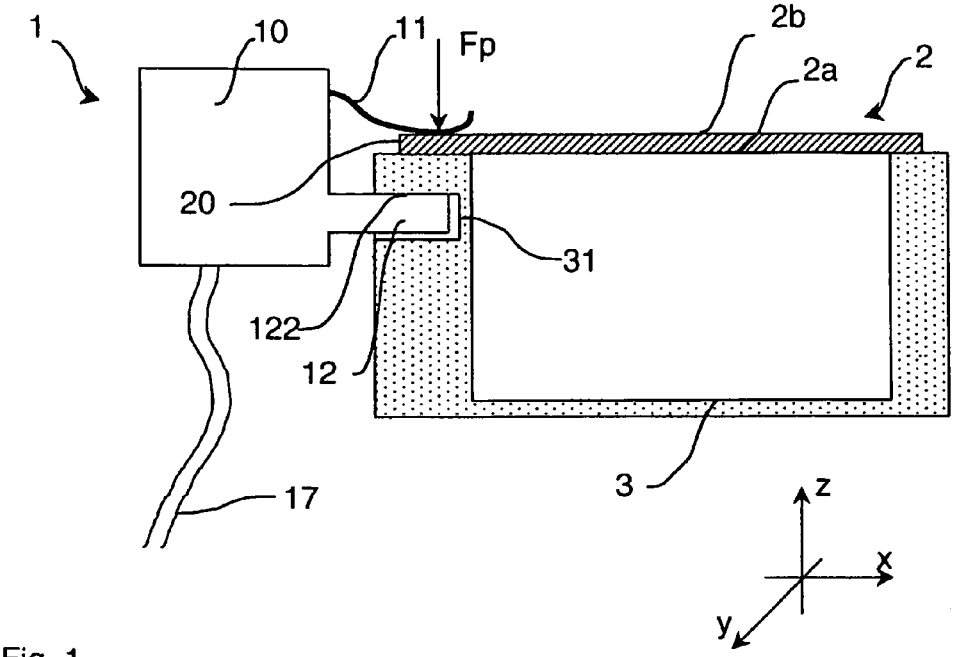
FIG. 1 represents a schematic cross-sectional view of an electrical connector positioned on a support according to a first preferred embodiment of the invention.

With reference to FIG. 1, according to a first preferred embodiment of the invention, an electrical connector 1 comprises a body 10 in which the first end of at least one metal blade 11 is connected to a conductor 17. Said at least one metal blade is preferably flexible.

The conductor 17, which is preferably flexible, is designed to be connected to another electrical component or is designed to be welded directly to an electrical component. The metal blade 11 and the conductor 17 are for example molded in the body 10 which is made of insulating material.

The electrical connector 1 according to the invention is designed to be connected to the edge 20 of a printed circuit card 2 having a first face 2*a* placed in contact with a support 3.

The second end of the metal blade 11 is designed to be in electrical contact with an electrical track 21 placed on a second face 2*b* of the printed circuit card 2. The electrical connector 1 comprises at least one securing means 12 designed to secure said connector on the edge of the printed circuit card 2. In addition, the securing means 12 are designed to secure said connector to the support 3. When the connector is placed on the edge of the printed circuit card, said at least one metal blade 11 is shaped in such a way as to be able to exert a gripping force Fp on the printed circuit card 2 to keep the latter in contact with the support 3. For example, the metal blade preferably has the shape of a half-loop. Application of the gripping force Fp enables movement of the electrical connector 1 and of the printed circuit card 2 to be limited in at least one direction Z perpendicular to the faces 2*a*, 2*b* of the printed circuit card 2. The gripping force Fp, depending on its intensity, can prevent movement of the electrical connector 1 and of the printed circuit card 2 relative to the support 3.

Said at least one securing means 12 of the connector comprises at least one first securing surface 122 which operates in conjunction with positioning means 31 of the support 3. Each securing means can take the form of an element that is salient with respect to the sides of the connector 1. The positioning means 31 can take the form of pins. The salient elements have at least one flat surface which comes into contact with the pins of the support to prevent movement of the connector with respect to the support.

According to one embodiment of the invention, the connector comprises two securing means 12 placed symmetrically with respect to a plane of symmetry of said connector.

According to a first preferred embodiment of the invention as represented in FIG. 1, the distance separating the metal blade 11 and the first securing surface 122 is greater than the thickness of the edge 20 of the printed circuit card 2. The printed circuit card 2 is in fact pinched indirectly between the metal blade 11 and said at least first securing surface 122. A part of the support 3 is in fact placed between the metal blade 11 and said at least first securing surface 122. In this way, due to the effect of the gripping force Fp, this part of the support 3 is therefore also pinched between the metal blade 11, the printed circuit card 2 and said at least first securing surface 122.

Figure 2:
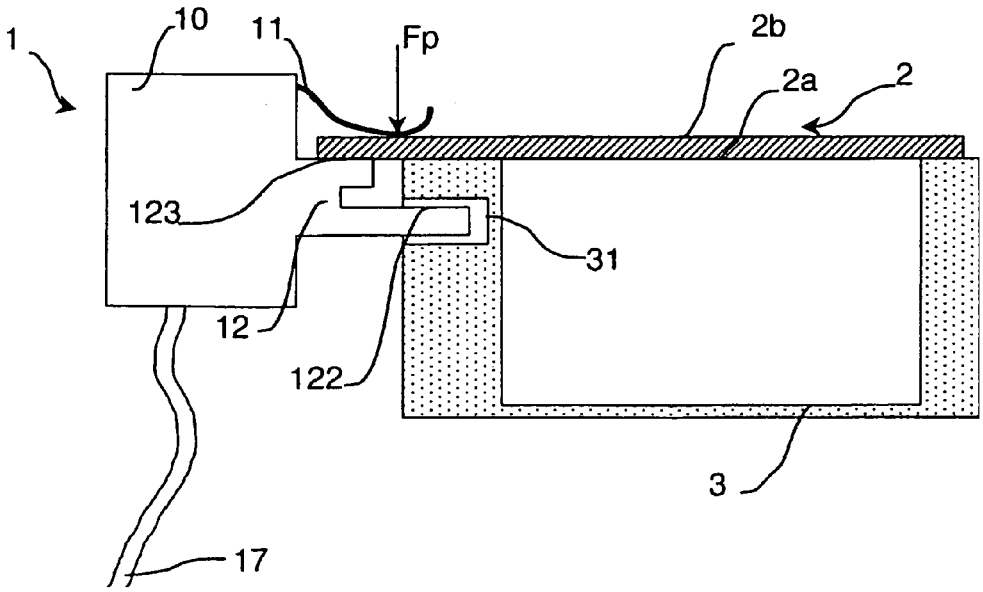
FIG. 2 represents a schematic cross-sectional view. of an electrical connector positioned on a support according to a second preferred embodiment of the invention.

According to a second preferred embodiment of the invention as represented in FIG. 2, said at least one securing means 12 of the electrical connector 1 comprises at least one second securing surface 123. The distance separating the metal blade 11 and the second securing surface 123 is substantially equal to the thickness of the edge 20 of the printed circuit card 2. When the connector is placed on the edge of the printed circuit card, the printed circuit card 2 is gripped directly between the metal blade 11 and said at least second securing surface 123. Said at least one first securing surface 122 operates in conjunction with the positioning means 31 of the support 3.

Thus, according to all the embodiments of the invention, when the electrical connector 1 is placed on the edge of the printed circuit card, the metal blade or blades comes or come into contact with a track 21 of the printed circuit card 2. The gripping force Fp exerted by the metal blade is then sufficient to obtain a low electrical contact resistance between the connector 1 and the track 21 of the printed circuit card 2. Furthermore, the gripping force Fp is also sufficient to secure the printed circuit card 2 on the support 3. The gripping force Fp is mainly due to deformation of the metal blade 11 at the moment the connector 1 is connected to the printed circuit card 2 placed on the support 3.

Figure 7:
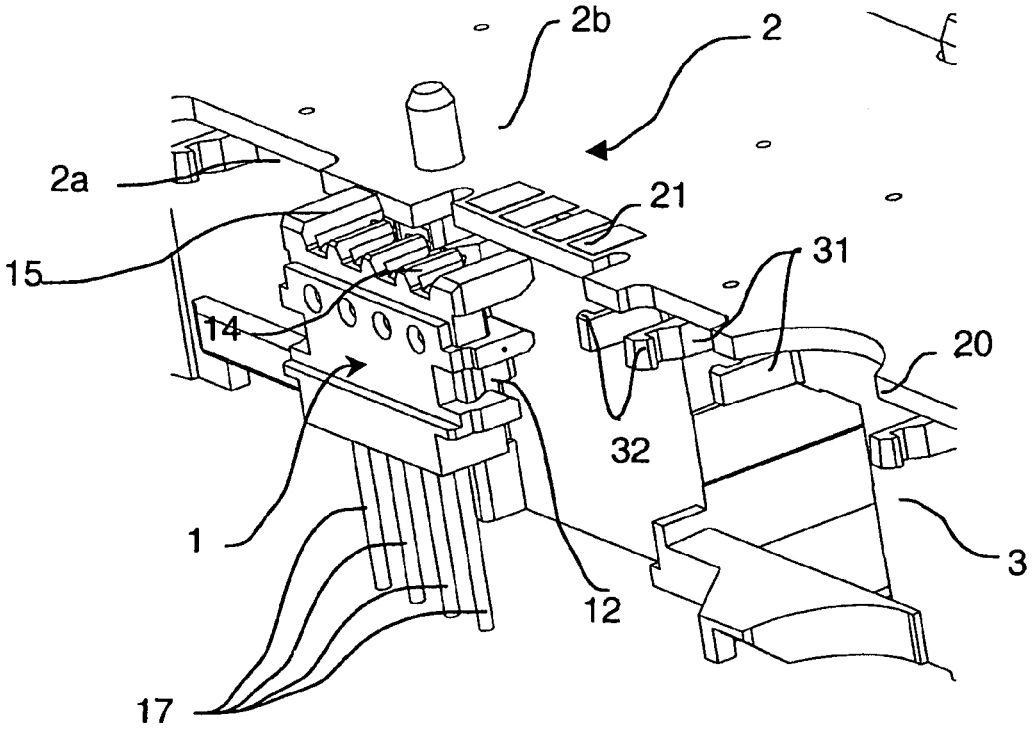
FIGS. 7 to 9 represent perspective views of the connector according to FIG. 2 during positioning on a printed circuit card.
Figure 8:
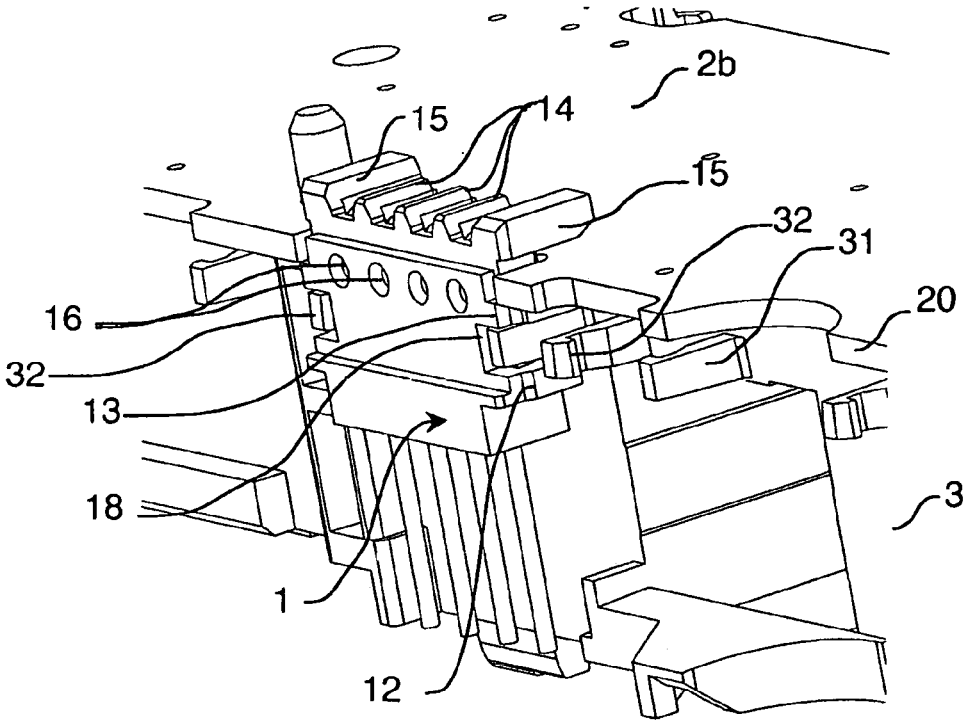
Figure 9:
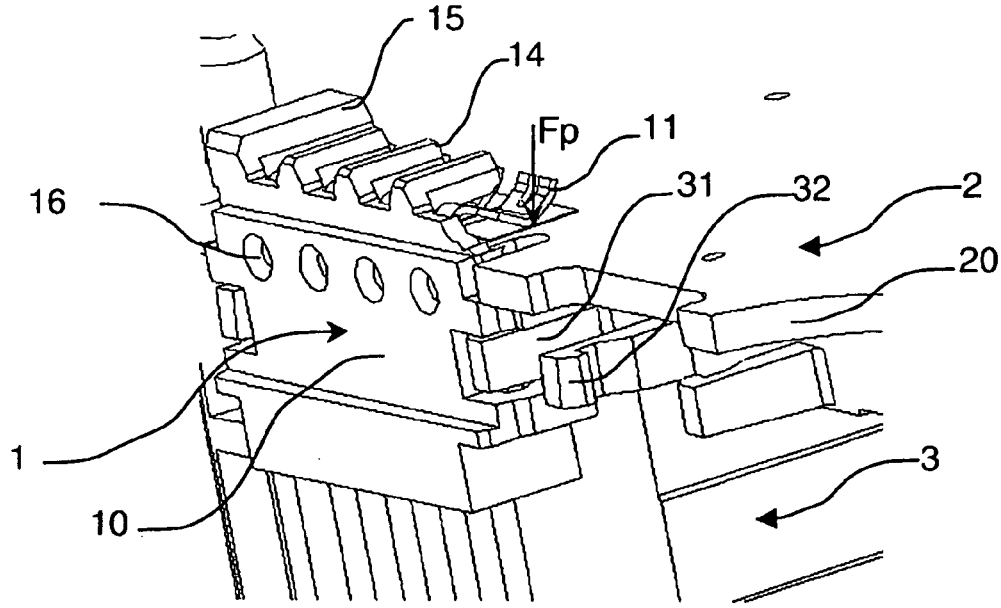
Figure 10:
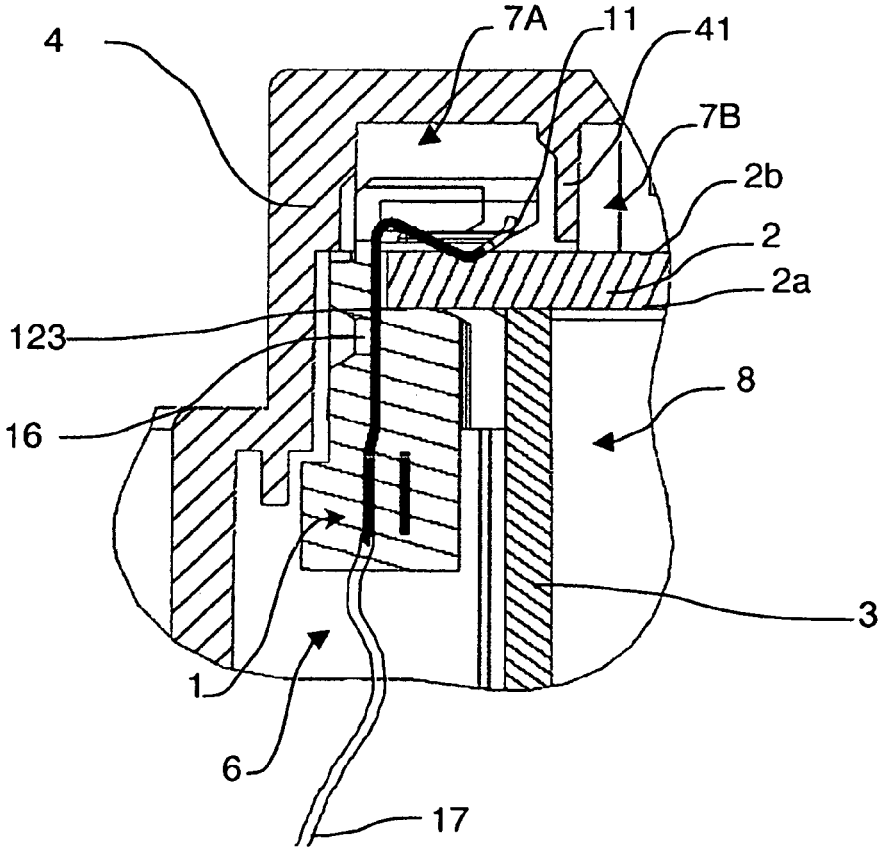
FIG. 10 represents a detailed cross-sectional view of a connector according to the invention placed in a sealed case.

As represented in FIG. 7, the electrical connector 1 comprises a latching zone 18 designed to operate in conjunction with at least one latching means 32 of the support 3. This collaboration of the latching zone 18 and of said at least one latching means enables movement of the electrical connector 1 to be limited in at least one direction X parallel to the faces 2*a*, 2*b* of the printed circuit card 2. According to the preferred embodiments of the invention as represented in FIGS. 5 to 9, each electrical connector is designed to collaborate with two latching means 32. The latching means 32 are placed at the ends of the positioning means 31 of the support 3. The salient element of each positioning means 31 comprises a latch at one free end, which latch positions itself on the latching zone 18 located at the rear of the electrical connector 1 when the latter is connected.

Figure 5:
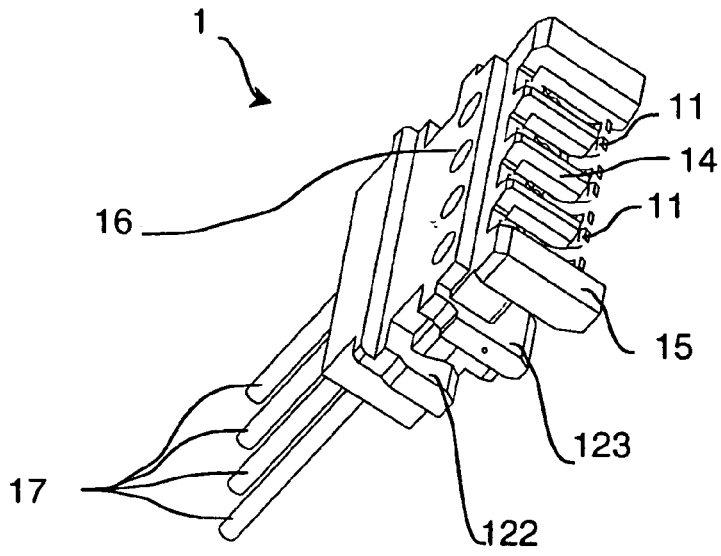
FIGS. 5 and 6 represent perspective views of the connector according to FIG. 2.
Figure 6:
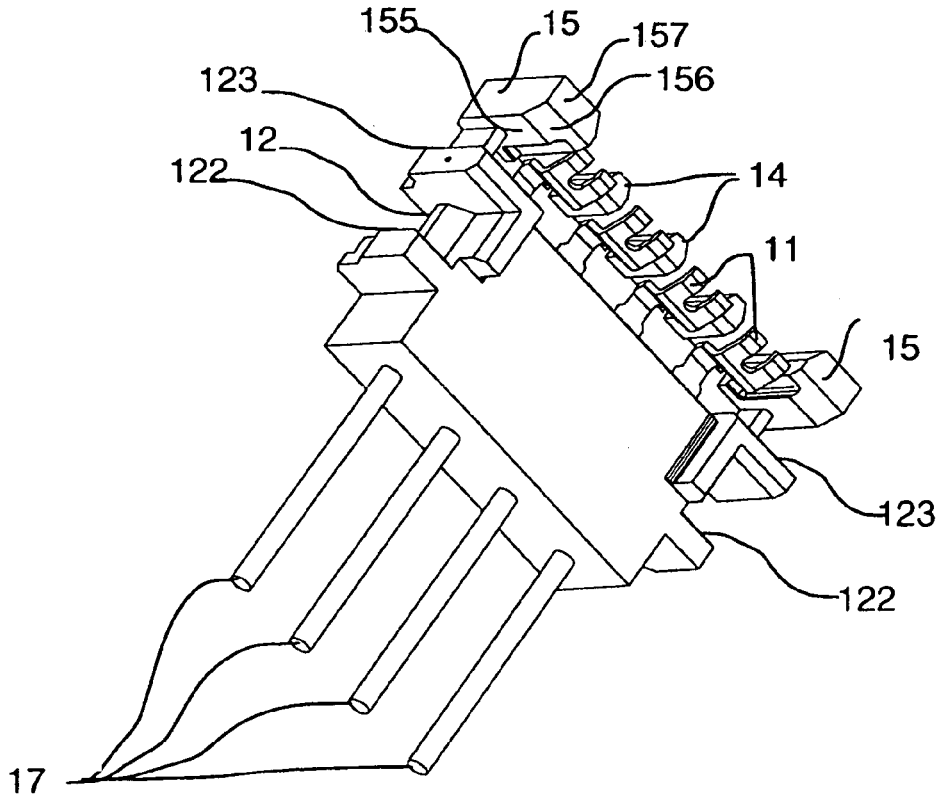

As represented in FIG. 5, the electrical connector I comprises at least two insulating centering fingers 15 placed in parallel manner on each side of said at least one metal blade 11. Each centering finger 15 comprises a front surface 155 designed to be facing the second face 2*b* of the printed circuit card 2. The centering fingers 15 preferably have a larger length than that of said at least one metal blade 11. This geometric configuration enables mechanical protection of said blade to be ensured at the time connection of the connector on the edge 20 of the printed circuit card 2 is performed.

According to an alternative embodiment of the centering finger 15, the latter comprises an inclined plane 156 at the level of the front surface 157 thereof perpendicular to the faces 2*a*, 2*b* of the printed circuit card 2. This inclined plane enhances the ease of insertion of the electrical connector 1 on the edge 20 of the printed circuit card 1.

According to the preferred embodiments of the invention as represented in FIGS. 1 to 9, the electrical connector 1 comprises several metal blades 11. Each metal blade 11 is designed to be connected to an electrical track 21 of the printed circuit card 2. The metal blades 11 are then separated by insulating separating fingers 14 placed parallel to said blades. The separating fingers 14 preferably have a smaller length than that of the metal blades 11.

According to an alternative embodiment of the electrical connector according to the different embodiments of the invention, the electrical connector 1 comprises at least one electrical test zone 16 respectively associated with a metal blade 1. The body 10 of the connector 1, which is made from insulating material, comprises openings giving access to a non-insulated electrical. surface connected to a metal blade 11. These openings are preferably placed on the face of the connector located opposite the face which is in contact with the edge 20 of the printed circuit card 2.

The invention also relates to an electrical case comprising a printed circuit card 2 connected to at least one electrical connector 1 as described above. Said card is positioned on a support 3 delineating at least one first internal confinement volume 8 inside the support 3.

The case also comprises a cover 4 designed to cover the printed circuit card 2 positioned on said support. The printed circuit card 2 comprises an electronic circuit located on the faces 2*a*, 2*b* of said card. The positioning of the cover 4 on the printed circuit card 2 enables at least one second internal confinement volume 7 to be delineated between the cover 4 and the second face 2*b* of the printed circuit card 2.

The cover 4 comprises an internal positioning periphery having a shape that is determined such as to collaborate with an external periphery formed by the edge 20 of the printed circuit card 2 whereon said at least one electrical connector 1 is connected.

The external periphery is situated in a plane parallel to the faces 2*a*, 2*b* of the printed circuit card 2. This external periphery is preferably situated in a plane which is substantially the same as that of the printed circuit card 2.

According to one embodiment of the invention, the external periphery is continuously in contact with the edge of the printed circuit card on which at least one electrical connector 1 is connected. The first and second confinement 8, 7 are therefore insulated with respect to the external volume 6 of the case.

According to one embodiment, the electrical circuit of the electrical case is designed for control of switchgear equipment such as circuit breakers. Each electrical connector 1 can be connected via the conductors 17 to a current sensor fitted around a current line. The case is generally placed in a zone near to the breaking zone of the circuit breaker. When current breaking takes place, the presence of ionized gases is liable to damage the electrical components of the electrical control circuit.

Figure 3:
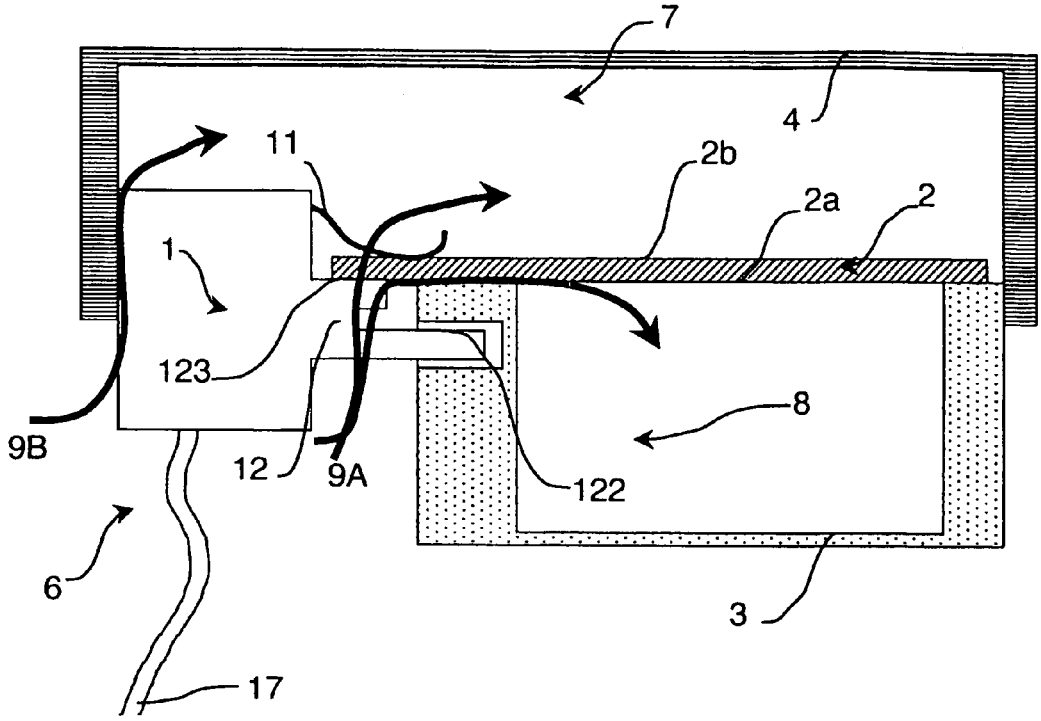
FIG. 3 represents a schematic cross-sectional view of a case comprising an electrical connector according to FIG. 2.
Figure 4:
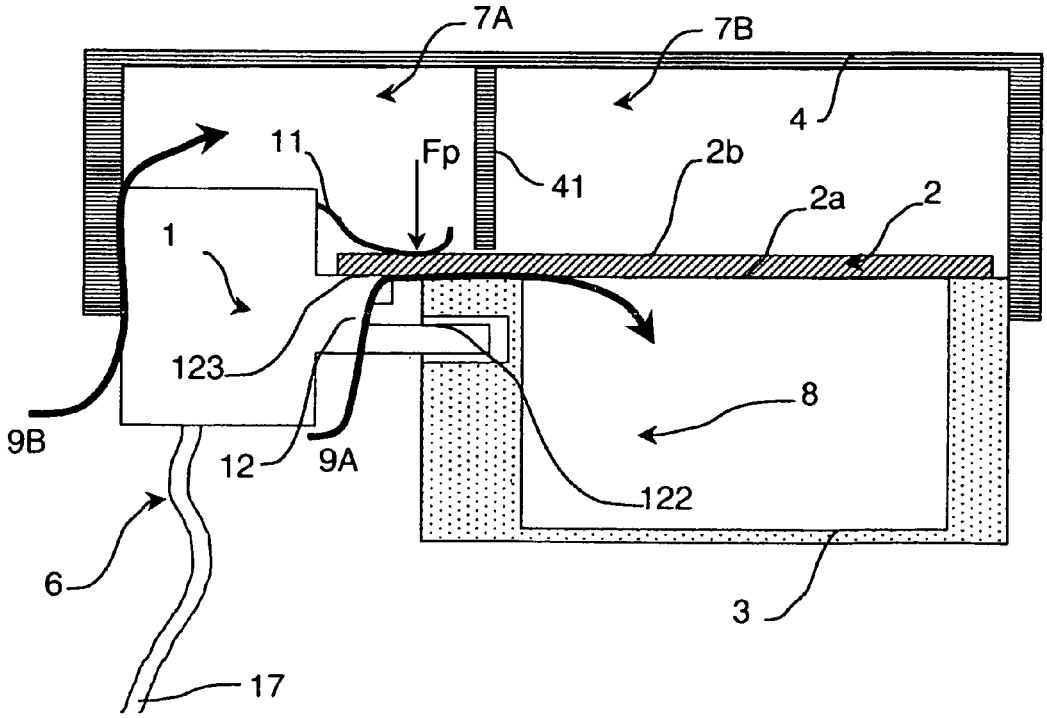
FIG. 4 represents a schematic cross-sectional view of an alternative embodiment of the case according to FIG. 3.

As represented in FIGS. 3 and 4, the finely adjusted positioning of the internal periphery of the cover with respect to the external periphery of the printed circuit card 2 and application of the gripping force Fp keeping said card and the support 3 in contact make it possible to significantly reduce the risk of fluxes 9A, 9B of polluting particles entering said internal confinement volumes 8, 7. The electrical or electronic components placed on the faces 2*a*, 2*b* of the printed circuit card 2 are therefore protected.

According to an alternative embodiment of the cover 4, at least one internal insulating wall 41 divides the first internal confinement volume 7 into two internal confinement sub-volumes 7A, 7B. This internal wall 41 creates an additional chicane preventing the fluxes 9B of polluting particles from passing from a first confinement sub-volume to the other.

According to an alternative embodiment of the electrical case, the electrical blades 11, the insulating separating fingers 14 and the insulating centering fingers 15 of the electrical connector or connectors 1 are preferably placed inside the same confinement sub-volume 7A.

We claim:

1. An electrical connector for connection to an edge of a printed circuit card located in contact with a support which is separate from the electrical connector, the electrical connector comprising:

at least one metal blade for contacting an electrical track located on a second face of a printed circuit card having a first face contacting a support, at least one securing means for securing the electrical connector on an edge of such a printed circuit card on such a support which is separate from the electrical connector, wherein said at least one metal blade is for:

exerting a gripping force on such a printed circuit card to keep it in contact with such a support, and limiting movement of the electrical connector and of such a printed circuit card with respect to such a support in at least one direction perpendicular to the faces of such a printed circuit card.

2. The electrical connector according to claim 1 wherein said at least one securing means comprises at least one first securing surface for operating in conjunction with a positioning means portion of such a support, said positioning means for preventing movement of the connector with respect to such a support.

3. The electrical connector according to claim 2 wherein a distance separating the metal blade and the first securing surface is greater than a thickness of such a printed circuit card at an edge thereof.

4. The electrical connector according to claim 3 for gripping such a printed circuit card indirectly between the metal blade and said at least first securing surface, when a part of such a support is between the metal blade and said at least first securing surface.

5. The electrical connector according to claim 2 wherein said at least one securing means comprises at least one second securing surface, a distance separating the metal blade and the second securing surface being equal to a thickness of such a printed circuit card at an edge thereof.

6. The electrical connector according to claim 5 for gripping such a printed circuit card directly between the metal blade and said at least second securing surface.

7. The electrical connector according to claim 1 comprising a latching zone for operating in conjunction with at least one latching means portion of such a support, thereby limiting movement of the electrical connector in at least one direction parallel to the faces of such a printed circuit card.

8. The electrical connector according to claim 1 comprising at least two insulating centering fingers located in parallel on each side of said at least one metal blade, each centering finger having a front surface for facing the second face of such a printed circuit card.

9. The electrical connector according to claim 7 wherein the centering fingers have a greater length than that of said at least one metal blade.

10. The electrical connector according to claim 7 wherein the centering fingers comprise an inclined plane at the level of their front surfaces for orientation perpendicular to the faces of such a printed circuit card.

11. The electrical connector according to claim 1 comprising several metal blades, each metal blade for connection to an electrical track of such a printed circuit card.

12. The electrical connector according to claim 11 wherein the metal blades are separated by insulating separating fingers parallel to said blades.

13. The electrical connector according to claim 12 wherein the separating fingers are of shorter length than that of the metal blades.

14. The electrical connector according to claim 1 wherein each metal blade is flexible.

15. The electrical connector according to claim 1 comprising at least one electrical test zone providing access to a non-insulated electrically conductive surface connected to a metal blade.

16. An electrical case comprising:

a printed circuit card connected to at least one electrical connector according to claim 1, said card positioned on a support which is separate from the electrical connector to which it is connected, said support being at least one first internal confinement volume inside the support, a cover covering the printed circuit card positioned on said support and defining at least one second internal confinement volume between the cover and a second face of said printed circuit card, wherein the cover comprises an internal positioning periphery cooperating with an external periphery formed by the edge of the printed circuit card and by said at least one electrical connector connected to said edge for reducing fluxes of polluting particles entering the first and second confinement volumes.

17. The electrical case according to claim 16 wherein the cover comprises an internal insulating wall dividing the first internal confinement volume into two internal confinement sub-volumes and for preventing fluxes of polluting particles from passing from a first confinement sub-volume to another confinement sub-volume.

18. The electrical case according to claim 16 wherein the metal blades, the insulating separating fingers and the insulating centering fingers of the electrical connector are inside the same confinement sub-volume.

* * * * *